United States Patent [19]

Kozel

[11] Patent Number: 4,884,050

[45] Date of Patent: Nov. 28, 1989

[54] BLADE TERMINAL TAP FUSE

[76] Inventor: Emmett L. Kozel, Rte. 1, Box 206, Rockingham, N.C. 28379

[21] Appl. No.: 220,314

[22] Filed: Jul. 18, 1988

[51] Int. Cl.[4] ..... H01H 85/22

[52] U.S. Cl. ..... 337/264; 337/255; 439/621; 439/830

[58] Field of Search ..... 337/264, 255, 257, 258, 337/260, 251, 252, 198, 266; 439/621, 624, 628, 830, 698, 622; 29/623

[56] References Cited

U.S. PATENT DOCUMENTS

| | | | |
|---|---|---|---|
| 3,909,767 | 9/1975 | Williamson et al. | 337/264 |
| 4,344,060 | 8/1982 | Ciesemier et al. | 337/255 |
| 4,499,447 | 2/1985 | Greenberg | 337/266 |

FOREIGN PATENT DOCUMENTS

| | | | |
|---|---|---|---|
| 2940607 | 4/1981 | Fed. Rep. of Germany | 337/255 |

*Primary Examiner*—H. Broome
*Attorney, Agent, or Firm*—Dowell & Dowell

[57] ABSTRACT

An electrically tappable miniature fuse which includes a housing from which the first ends of a pair of parallel blade terminals extend for engaging the contact elements in a fuse box or panel and where in at least one of the blade terminals includes a second end which is freely accessible either within, or which extends from, the housing remote from the first end thereof so as to permit an electrical connector to be selectively engagable therewith.

11 Claims, 2 Drawing Sheets

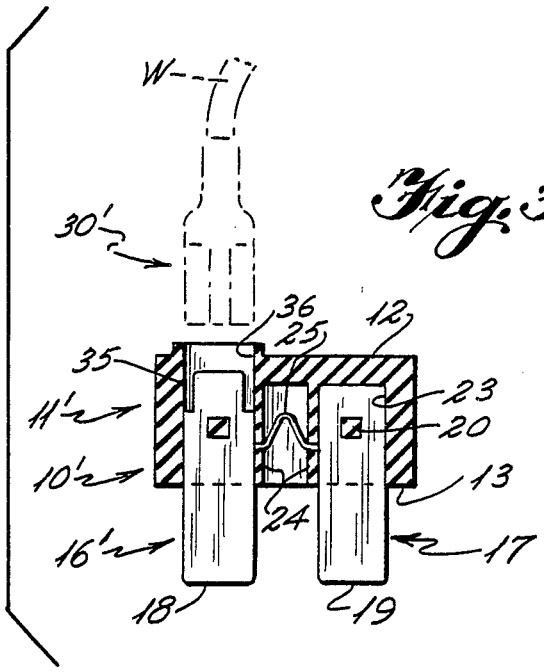
Fig. 3
Fig. 4
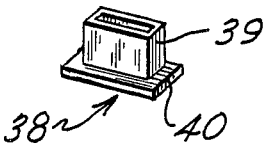
Fig. 5
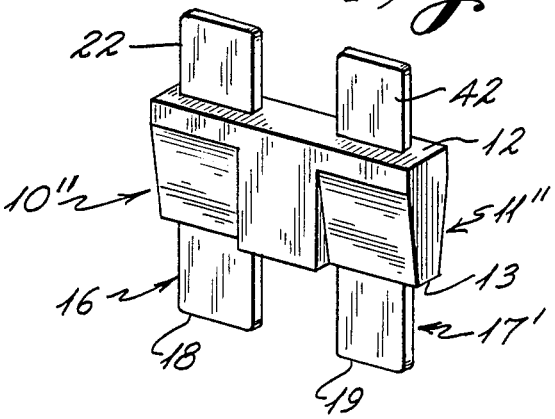

BLADE TERMINAL TAP FUSE

BACKGROUND OF THE INVENTION

1. Field of the Invention

This invention is generally directed to miniature fuses of the type which are normally associated with automotive vehicles and more specifically to blade type terminal fuses which are adapted to provide a tappable electrical connection for use in installing auxiliary electrical equipment within a vehicle or other equipment without requiring the electrical wiring or electrical harnesses associated with the electrical system of the vehicle or equipment to be disturbed or spliced. The tap fuses of the present invention permit auxiliary electrical equipment to be connected to a vehicle or other electrical system by directly tapping a source of electrical power through the fuse elements conventionally associated with such systems. In one embodiment of the invention, one of the blade terminals of each fuse extends outwardly or is spaced from the fuse housing so as to be accessible to a female electrical connector mounted at the remote or free end of an electrical wire or cable associated with the auxiliary equipment being installed.

In one form of the invention, the auxiliary blade terminal extends from the insulated housing which normally surrounds the terminals of the fuse so that the electrical connection is made exteriorly with respect to the housing. In this embodiment, the auxiliary terminal may be selectively covered by a protective insulated cap when not in use.

In another form of the present invention, the auxiliary blade terminal may be mounted within in a recess within the housing which recess is of a size to permit a female electrical connector to be inserted therein to electrical contact the auxiliary blade terminal.

In another embodiment of the present invention, both of the blade terminal elements of the fuse will include remote auxiliary end portions which may be tapped by a pair of electrical connectors mounted to the remote or free ends of a pair of wires or electrical conductors which extend to a remote fuse condition indicator panel. In this manner, the condition of the fuse element may be displayed to a remote location such as the dashboard of the vehicle so that the vehicle operator will have an immediate indication as to a blown fuse. In this embodiment, the auxiliary blade terminal elements may either be recessed within the housing or extend from the housing as in the case with the first embodiment of the invention.

2. Description of the Related Art

Until recently, the automotive and other industries have relied entirely on conventional cylindrical glass fuses to protect against electrical overloads and overheating in low amperage electrical wiring. Such fuses are generally placed in electrical circuits so as to prevent an overload due to faulty wiring or equipment conditions with the amperage ratings of the fuse elements generally not exceeding 25 amps. In vehicles, such electrical systems may control the operation of headlights, tail lights, running lights, dashboard lights, instrumentation, horns, wiper systems, electrical doors, windows and locks, radios and other associated equipment. As many vehicle operators have experienced over the years, the simple matter of a blown fuse in an electrical circuit can be a very complicated and time consuming replacement project.

Often times the fuse panels or boxes for automotive and other equipment are placed in inconvenient locations, either beneath the dashboards or within closed compartments. Due to the complexity and the problems associated with replacing conventional glass type cylindrical fuses, the automotive and other industries have begun utilizing what are known as miniature blade fuses. Blade fuses are more compact and easily handled during replacement and removal and provide not only an economy of space but are easier to manipulate when being placed into an electrical panel or box. Miniature blade fuses are generally constructed of a conductive metallic material which is embedded into an insulated housing which is easily gripped for manipulation. The fuses include parallel and coplanar terminal blades that extend outwardly so as to be engagable within the sockets provided within fuse boxes or panels. The terminals are connected by a thin strip of conductive material which extends between the terminals within the housing. The housings are generally designed so that when the thin fuse strip overheats and melts or breaks an indication of the failed condition of the fuse is easily discernable through the housing. Examples of such prior art blade type fuses are disclosed in U.S. Pat. Nos. 3,909,767 to Williamson et al and 4,999,447 to Greenberg.

Unfortunately, although there has been significant improvement in the economy and the handling of fuse elements utilized in flat blade type fuses, there remain problems which are encountered on a regular basis with respect to the installation of new electrical equipment into a vehicle's or other equipment's electrical system. In many instances, it may be desired to install auxiliary electrical equipment such as radios, cassette players, television sets and telephones into cars, trucks, vans and the like. When this equipment is installed in a vehicle, it must be connected to the vehicle electrical system. In order to accomplish this, prior art techniques have required that the electrical line from the equipment be tapped to one of the electrical wires leading to or from the fuse box or fuse panel. This type of connection not only is unsafe but requires a great deal of experience in knowing which lines of the electrical system can be appropriately spliced to provide power to the auxiliary electrical equipment. This process is both time consuming and costly and often requires the need of experienced personnel. However, even with experienced personnel, electrical harnesses are often overly complex and require that electrical diagrams of the electrical system be available. This requires that installers have access to the electrical diagrams of many types of automotive vehicles or other electrical systems.

Even with sufficient knowledge to install such auxiliary equipment, a great deal of work is often involved when it becomes necessary to disassemble a wiring harness and obtain a splice connection with an appropriate electrical line. To forego this problem, some installers make an electrical connection directly with one of the fuse elements or fuse contacts in a fuse box. This is generally accomplished by taking a small gauged electrical wire and wrapping it around the blade contact of a conventional blade type fuse and then inserting the fuse back into to its electrical socket. Such splices are not only unsafe but are not reliable. Due to the small dimensions between the terminal blades of conventional blade fuses, any attempt to wrap or otherwise attach a supplemental electrical wire to one of the blade terminals can result in an arcing between the terminals creating a safety problem or resulting in the destruction of the fuse element. Further, many auxiliary electrical lines include larger gauge electrical wire and are not therefore easily wrapped, soldered or secured to the terminal blades. In these instances, a secondary splice must be made between the large wire and a smaller wire and thereafter the mechanical splice being made to the blade terminal of the flat blade fuse.

Even without regard to the obvious safety problems involved with making mechanical splices to existing blade type fuses, due to the remote location of the fuse elements themselves, installation can be extremely difficult. Even where the splice is made while the fuse is out of a fuse box, attempting to re-align the fuse blades to their proper contacts within the box with the auxiliary electrical wire attached thereto can be a challenging task.

In view of the foregoing, it is necessary to provide a convenient, easy, safe and reliable method for providing a connection to a source of electrical energy for auxiliary electrical equipment especially in automotive vehicles. Further, by providing a source of tappable electrical energy through a fuse element, it is possible to install the equipment in a safe manner insuring that the electrical line will be protected from overload and overheat conditions.

SUMMARY OF THE INVENTION

This invention is directed to a miniature blade type fuse having a pair of parallel and generally coplanar terminal elements which are mounted within an insulated housing and which are interconnected by a thin fuse element or metallic strip within the housing. Each of the blade elements includes a first end which extends outwardly from the housing so as to provide for normal electrical contact with the socket of a fuse box or panel. In one embodiment of the invention, at least one of the blade elements includes an auxiliary end which is spaced from the surrounding insulated housing so as to provide a tappable source of electrical energy. Such auxiliary or second end of one of the blade elements is designed to permit an electrical connector to be attached thereto so that electrical energy passing through the fuse element may be utilized to power auxiliary electrical equipment. In a first form of one embodiment of the invention, the auxiliary end of the blade terminal extends outwardly from the housing so as to be easily accessible for a female electrical connector to be secured thereto. When not in use, an insulated cover may be placed over the blade terminal to insure that no arcing or accidental grounding is possible. In a second form of the first embodiment of the invention, the auxiliary terminal end is recessed within the fuse housing with a space being provided around the auxiliary terminal so that a female electrical connector may be inserted within the space in surrounding relationship with the auxiliary terminal. Again, to prevent any accidental arcing, contact, or grounding of the terminal element, a plug may be inserted within the recess created in the housing when the auxiliary terminal is not in use.

In a second embodiment of the present invention, each of the blade terminal elements associated with the fuse include an auxiliary blade end which may be formed either extending from the housing or inset within the housing. In this embodiment, an electrical circuit may be created through the fuse so that a remote indication of the condition of the fuse may be readiliy displayed to the operator of a motor vehicle or other type of equipment. With this system, a remote display box would have a first lead extending to one of the blade terminal elements and a second lead extending from a visual light source or other indicator in the display box to the other blade terminal element. In the event that a fuse fails, the indicator would reflect the inoperable condition of the fuse element. Again, when not in use, a protective cap would be provided over the auxiliary ends or plugged into the recesses created in the housing for the auxiliary terminals.

In either embodiment of the present invention, the contacts which are made with the auxiliary terminals should be insulated to insure that no arcing or direct contact can be made with such elements.

It is a primary object of the present invention to provide a tap adapter for low current electrical systems which includes a flat blade type miniature fuse wherein one or more of the fuse blades includes an auxiliary terminal which may be tapped by an auxiliary or outside electrical line so as to provide a source of electrical energy to a remote electrical component.

It is another object of the present invention to provide a flat blade type fuse element with auxiliary electrical terminals which permit the fuse to be tapped directly without requiring further modification to the fuse box or the associated electrical wiring incorporated with the electrical system going to and from a fuse box.

It is also an object of the present invention to provide miniature low voltage fuse elements of the type which are conventionally utilized in automotive vehicles with auxiliary terminal elements which may be selectively utilized and tapped to provide a source of electrical energy to a remote electrical component and wherein the electrical contact is created without having to disturb the vehicle wiring or the wiring harness associated therewith.

It is another object of the present invention to provide miniature flat blade type fuses which may include a pair of auxiliary electrical contacts or terminals which may be selectively tapped so as to create an electrical circuit which may be utlized to give a remote indication of the continuity of the fuses.

BRIEF DESCRIPTION OF THE DRAWINGS

FIG. 3 is a cross sectional view similar to that of FIG. 1 taken through an alternative embodiment of the present invention wherein the auxiliary terminal is oriented within the fuse housing and showing in dotted line the auxiliary electrical connector being brought into aligned relationship to make the electrical connection.

FIG. 4 is a perspective view of an insulating cap which fits into the opening in the fuse element of FIG. 3 so as to electrically insulate the auxiliary terminal when not in use.

FIG. 5 is a perspective view of a another embodiment of the present invention showing a pair of auxiliary terminals.

DESCRIPTION OF THE PREFERRED EMBODIMENT

Figure 1:
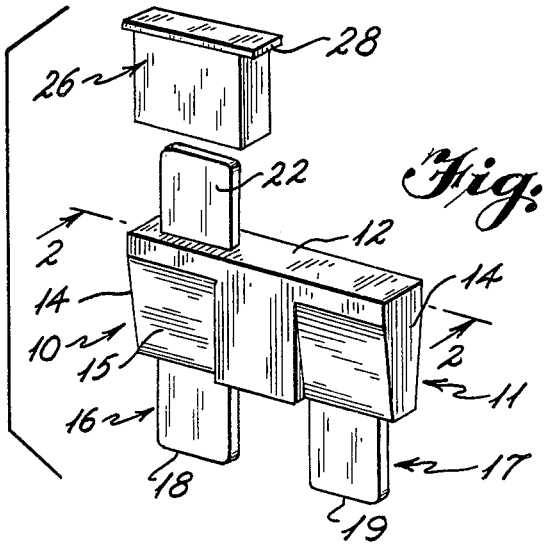
FIG. 1 is a perspective view of the first embodiment of the present invention showing an electrically insulated cap for covering the auxiliary terminal of the fuse when not in use.
Figure 2:
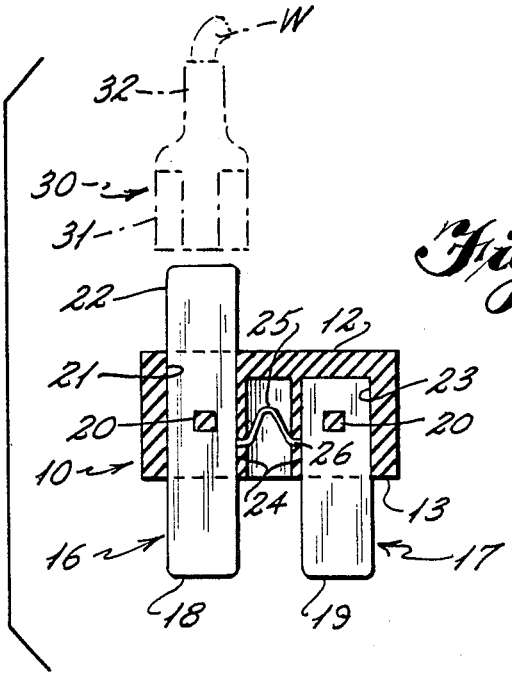
FIG. 2 is a cross sectional view taken through lines 2—2 of FIG. 1 and showing in dotted line an electrical connector being brought into overlapping relationship with respect to the auxiliary terminal of the fuse.

With continued reference to the drawings, FIGS. 1 and 2 show a first embodiment of the present invention. In this embodiment, the tap fuse is designed to provide a quick connect for an auxiliary electrical line or wire W such as shown in dotted line in FIG. 2. The wire may extend to an electrical component or unit which is to be connected to the electrical system in which the fuse is utilized. As previously discussed, it is the primary intent of the present invention to provide a tap for flat blade fuses which are conventionally used in the automotive industry. Such fuses are rated generally between 5 and 30 amps and are placed within a fuse box so as to terminate the electrical circuit from the power source to an electrical unit when there is an over-voltage or the wire is overheated.

When it is desired to install an auxiliary electrical component such as a telephone or radio in an automobile, it is necessary to connect such components to the vehicle's electrical system. By utilizing the tap adapter shown in FIGS. 1 and 2, it is possible to accomplish the connection directly through the fuse elements in the vehicle's electrical system. In this embodiment, the tap fuse 10 includes an insulated plastic body portion 11 having an upper end 12, lower end 13, sidewalls 14 and front and rear walls 15. The housing 11 is formed of a suitable electrical insulated plastic material which may be molded about the remaining conductive components of the fuse. Such plastics not only exhibit electrical insulating properties but are fire resistent and may include nylon, polystyrenes and the like. Preferably, the housing is transulscent or transparent so that the condition of the fuse link embedded therein can be determined visually.

The tap adapter includes a pair of electrically conducting blade elements 16 and 17 which have first end portions 18 and 19 extending outwardly from the lower end 13 of the housing. The end portions 18 and 19 of each of the terminal elements 16 and 17 are designed to be engagable within a female socket of a fuse box or panel (not shown).

Each of the blade elements 16 and 17 includes an opening generally indicated at 20 through which the plastic material forming the housing may h=molded when the fuses is formed. The blade element 16 is shown as extending through a channel 21 having openings along the upper and lower surfaces of the the housing. The blade element 16 therefore includes an upper extending auxiliary end portion 22 which is designed to provide an electrical tap for the electrical wire W. Blade element 17 is shown as being shorter and not extending through the housing 11 but being embedded within a closed channel 23 which is open only along the lower end 13 of the housing. The two blade elements 16 and 17 are separated by a pair of electrically insulating walls 24 which are provided to prevent any arcing of current between the blade elements. An electrical contact is established between the blade elements 16 and 17 by a metallic or other electrically conductive fuse element 25 which extends through openings 26 molded in each of the walls 24. In practice, it is generally preferred that the blade elements 16 and 17 be integrally formed with the small connecting fuse element 25. Such materials may be stamped from a sheet of metallic or other conductive material with the connecting element being of a size to determine the proper amperage rating for the fuse. In use, when the connecting element 25 fails due to electrical conditions in a circuit, the transparent housing will permit a visual inspection to verify the fuse should be replaced.

When the tap fuse 10 of the present invention is not in use, a separate electrically insulated cover or cap 27 is provided which fits over and closely engages the auxiliary portion 22 of the blade element 16. The cover or cap includes a main body portion having an opening therein which is of a size to cooperatively receive the upper end or auxiliary end 22 of blade element 16. The body portion also engages the upper end 12 of the tap fuse when placed over the auxiliary blade element 22. The cover further includes outwardly extending flanges 28 which may be engaged by a screwdriver or by finger nail so as to lift the cover from the auxiliary blade element 22.

With the cover removed, the tap adapter of the present invention is ready to be utilized to provide a source of electrical power to an auxiliary electrical component which is to be connected to the electrical system in which the fuse is installed. As shown in FIG. 2, a crimpable connector element 30 is attached to the free end of the electrical wire W. The crimpable connector includes an outermost insulated housing 31 which extends upwardly over the splice with the electrical wire as shown at 32. By placing the crimpable connector over the auxiliary end 22 of blade element 16, an electrical contact is immediately established through the electrical wire 20 to a remote electrical component (not shown).

With specific reference to FIGS. 3 and 4, a second embodiment of the invention is disclosed in greater detail. In this embodiment, the tap fuse 10' includes a housing 11 which is substantially identical to the housing shown and discussed above with respect to the embodiment of FIGS. 1 and 2. The only difference between the two housings is that the channel 21 in which the blade contact element 16' is located includes a bore 36 along the upper portion of the channel adjacent to the upper end 12. The bore 36 is of a size to permit a female electrical connector 30' to be inserted therein in order to contact the blade element 16'.

The blade contact element 16' of the present embodiment is also modified and includes an upper or auxiliary contact element 35 which is spaced inwardly of the housing so as be positioned totally within the bore 36. In this manner, the auxiliary contact element 35 is positioned entirely within the electrically insulated housing. When electrical contact is desired, the electrical connector is inserted within the bore in the housing as opposed to being inserted over the contact element outside of the housing as was the case with the prior embodiment.

When the electrical contact element 35 is not in use, an electrically insulated cover or cap member 38 is provided which includes a rectilinear sleeve 99 of a size to fit over the electrical contact element 35 and is cooperatively seated within the bore 36. The cover 38 includes outwardly extending flange portions 40 which provide a gripping surface for removing the cover from its covering engagement with the contact element 35. In the present embodiment, the female electrical connector 30' is somewhat smaller than the connector 30 disclosed with respect to the embodiment of FIGS. 1 and 2. In order to prevent any electrical arcing or short in the system, the connector is provided with an electrically insulated sleeve which completely surrounds the electrical contact elements.

With specific reference to FIG. 5, a third embodiment of the present invention is shown in greater detail. In this embodiment, the tap fuse 10'' is shown as including a housing 11'' which is substantially identical to the housing discussed above with respect to FIGS. 1 and 2 with the exception that the channel 23 shown in FIG. 2 is made completely through the housing so as to be open through the upper end 12 and lower end 13. In the present embodiment, both of the fuse blade contact elements 16 and 17'' include auxiliary upper end portions 22 and 42 respectively. The auxiliary end portions are integrally formed with the blade element and provide electrical contacts through each of the blade elements of the fuse. In this manner, an electrical circuit can be created through blade elements 16 and 17' to a remote indicator source by connecting electrical wires (not shown) from the auxiliary element 22 to a remote panel where an indicator light is connected in series with a second wire (not shown) which is connected to the auxiliary blade element 42. In this embodiment, when the fuse link 25 which is located within the housing fails due to a condition in the circuit, the indicator light connected through the blade elements of 16 and 17' will give a visual indication of the failure. As with the prior embodiments, when blade contacts 22 and 42 are not in use, they are covered with a protective and electrically insulated cover or cap similar to that shown in FIG. 1. As an alternative, a single protective cover may be provided to extend over both of the blade elements 22 and 42. As a further alternative, the blade elements 22 and 42 may be formed similarly to the auxiliary blade element 35 shown in FIG. 3. In this embodiment, the blade elements 22 and 42 would be located within the housing and the electrical connection would be made in a manner similar to the connection discussed with respect to the embodiment of FIGS. 3 and 4.

The tap fuses of the present invention are utilized in place of the conventional blade type fuses conventionally utilized with automobile and other electrical circuits and which usually have amperage ratings not exceeding 25 to 30 amps. The tap fuses are installed in the same manner as conventional blade type fuses. However, when it is necessary to connect an auxiliary electrical unit or component to an electrical system, the connection may be made directly through the tap fuse without requiring modification to the fuse or without requiring unsafe electrical connections to be made by splicing wires or wrapping a blade of a conventional fuse with a conductor. The tap fuses therefore make it possible to safely and quickly install auxiliary electrical equipment to an electrical circuit without disrupting the electrical harnessing or wiring and provide a safe contact between the various electrical components. For safety, it should be assumed that any auxiliary or add-on electrical equipment employ the use of an in-line or built in fuse for its own protection as well as protection of the electrical system.

I claim:

1. An electrically tappable miniature fuse to which an electrical conductor may be connected by way of an electrical connector comprising an electrically insulated housing having upper and lower ends, a pair of spaced and generally parallel electrically conductive blade elements mounted within said housing, an electrical fuse link extending between and connecting said pair of blade elements within said housing, each of said blade elements having a first end extending outwardly from said lower end of said housing, at least one of the said blade elements having an auxiliary end spaced from said end of said blade elements and extending outwardly of said upper end of said housing whereby said auxiliary end provides an electrical contact through the fuse to which the electrical connector may be selectively mounted.

2. The miniature fuse of claim 1 in which said blade element and said fuse link are integrally formed of a common electrically conductive material.

3. The miniature fuse of claim 2 in which said housing is molded about said blade elements and said fuse link.

4. The miniature fuse of claim 1 including electrically insulated cap means, said cap means being of the size to enclose said auxiliary end of said at least one blade element when said auxiliary end is not in use.

5. The miniature fuse of claim 1 in which the fuse link has an amperage rating up to approximately 30 amps.

6. The miniature fuse of claim 1 in which both of said blade elements include an auxiliary end, each of said auxiliary ends being spaced from one another and extending outwardly of said upper end of said housing.

7. The miniature fuse of claim 6 including electrically insulated cap means, said cap means being the size to enclose said auxiliary ends of said blade elements when the auxiliary ends are not in use.

8. A combination electrically tappable miniature fuse to which an electrical conductor may be connected by way of an electrical connector comprising an electrically insulated housing having upper and lower ends, a pair of spaced and generally parallel electrically conductive blade elements mounted within said housing, an electrical fuse link extending between and connecting said pair of blade elements within said housing, each of said blade elements having a first end extending outwardly from said lower end of said housing, at least one of the said blade elements having an auxiliary end spaced from said first end of said blade elements, an electrical connector of a size to be selectively mounted to said auxiliary end, said housing including a bore therein remote from said lower end, said auxiliary end of said at least one blade element being disposed within said bore, said bore being of a size to permit said electrical connector to be situated therein when in contact with said auxiliary end whereby said auxiliary end provides an electrical contact through the fuse to which the electrical conductor may be selectively connected.

9. The miniature fuse of claim 8 including electrically insulated cap means, said cap means being of a size to close said bore in said housing when said auxiliary end is not in use.

10. The miniature fuse of claim 9 in which said blade elements and said fuse link are integrally formed of a common electrically conductive material.

11. The miniature fuse of claim 10 in which said housing is molded about said blade elements and said fuse link.

* * * * *